US007724912B2

(12) United States Patent
Tracy

(10) Patent No.: US 7,724,912 B2
(45) Date of Patent: May 25, 2010

(54) SPEAKER ASSEMBLY

(76) Inventor: Dennis A. Tracy, 11136 Washington Blvd., Culver City, CA (US) 90232

( * ) Notice: Subject to any disclaimer, the term of this patent is extended or adjusted under 35 U.S.C. 154(b) by 1009 days.

(21) Appl. No.: 11/455,664

(22) Filed: Jun. 20, 2006

(65) Prior Publication Data

US 2007/0291975 A1 Dec. 20, 2007

(51) Int. Cl.
*H04R 1/00* (2006.01)
*H04R 1/02* (2006.01)

(52) U.S. Cl. ..... 381/397; 381/386

(58) Field of Classification Search ..... 381/86, 381/87, 332, 386, 389, 397, 431
See application file for complete search history.

(56) References Cited

U.S. PATENT DOCUMENTS 5,909,015 A * 6/1999 Yamamoto et al. ..... 381/397

* cited by examiner

*Primary Examiner*—Brian Ensey
(74) *Attorney, Agent, or Firm*—Welsh & Flaxman LLC

(57) ABSTRACT

A speaker assembly includes a rigid, structurally stable and self supporting housing within which at least a first driver is mounted and enclosed. The housing including a first aperture formed in a first wall of the housing. The first driver includes a cone coupled to a driver magnet for generating sound. The driver magnet is seated within the first aperture exposing a portion of the driver magnet to an exterior of the housing. The driver magnet is encircled by a foam gasket member, the foam gasket member being shaped and dimensioned to permit air-flow about the magnet.

16 Claims, 7 Drawing Sheets

SPEAKER ASSEMBLY

BACKGROUND OF THE INVENTION

1. Field of the Invention

The invention relates to a speaker assembly. More particularly, the invention relates to a speaker assembly with reduced size and weight, yet retaining robust structural integrity and simplified integration allowing optimum placement and excellent performance of the speaker assembly within an aircraft.

2. Description of the Prior Art

The current global community has made it possible for people from around the country, and around the world, to interact for both business and personal reasons. For many people, this requires they spend considerable time traveling from one location to another location. More often then not, these people travel in aircraft.

Whether these people travel in private or commercial aircraft, they desire high quality entertainment during the many hours they spend within the confines of an aircraft. While, high quality entertainment, for example, digital video with CD quality sound, is readily available for theatre and home use, the weight and size requirements for use of such equipment in an aircraft makes it very difficult to incorporate high fidelity systems within an aircraft. This problem is especially pronounced for audio speaker assemblies when one attempts to meet the size, weight and shape requirements for use in aircraft.

The aircraft industry places great priority upon component weight and size reduction. Range and payload are adversely affected by conventional terrestrial designs. These concerns are notable when one attempts to make changes within smaller private jets. For example, a small increase in the weight carried by an aircraft results in a substantial increase in the fuel consumption of the aircraft. In addition, the limited space available within an aircraft dictates the use of any space within the aircraft be carefully considered by those responsible for ensuring the comfort of passengers.

Lightweight and compact audio speakers are currently available. These speakers, however, substantially compromise sound quality for reduction in size and weight. With this in mind, an individual wishing to add an audio system to an aircraft must make a choice between high fidelity speakers, which do not suit the size and weight requirements of the aircraft or lower quality speakers providing desirable size and weight characteristics.

Another concern encountered in the incorporation of speakers within an aircraft is the fact the speakers are generally confined within an enclosed space offering little in the way of airflow for cooling the driving components of the loudspeakers. In addition, the small spaces available within an aircraft also dictate that the speaker housing be relatively small. This further creates heating problems as little air is available within the housing for the cooling of speaker components. As such, speakers are susceptible to overheating, which may result in damage thereto or failure of the component.

More particularly, and as those skilled in the art will certainly appreciate, the voice coil of a conventional driver generates heat which is then dissipated to the surrounding driver structure, that is, the driver magnet, etc. This heat must be "bled off" to maintain the driver at an appropriate operating temperature or the performance of the speaker will be compromised.

A need, therefore, exists for a speaker assembly providing high-fidelity sound, while also accommodating the size and weight constraints of an aircraft. The present invention provides such a speaker assembly.

SUMMARY OF THE INVENTION

It is, therefore, an object of the present invention to provide a speaker assembly including a rigid, structurally stable and self supporting housing within which at least a first driver is mounted and enclosed. The housing includes a first aperture formed in a first wall of the housing. The first driver includes a cone coupled to a driver magnet for generating sound. The driver magnet is seated within the first aperture exposing a portion of the driver magnet to an exterior of the housing. The driver magnet is encircled by a resilient gasket member, the gasket member being shaped and dimensioned to permit airflow about the magnet.

It is also an object of the present invention to provide a speaker assembly wherein the gasket member is positioned between an inner surface of the first wall of the housing and the first driver.

It is also another object of the present invention to provide a speaker assembly wherein the gasket member includes a series of open spaces between the gasket member and the driver magnet such that as the first driver is actuated, moving air within the enclosure of the housing, the air is forced through the open spaces such that it circulates about the magnet in a manner cooling the driver magnet.

It is also a further object of the present invention to provide a speaker assembly wherein the open spaces extend about the driver magnet.

It is another object of the present invention to provide a speaker assembly wherein the open spaces are created by forming the gasket member with a step construction.

It is still another object of the present invention to provide a speaker assembly wherein the gasket member includes an annular base secured directly to the inner surface of the first wall, and a series of spaced first elevation members secured to the base defining open spaces therebetween.

It is a further object of the present invention to provide a speaker assembly including a series of spaced second elevation members secured to the respective first elevation members in a manner further defining open spaces.

It is yet a further object of the present invention to provide a speaker assembly including a second driver mounted and enclosed within the housing. The housing further includes a second aperture formed in the first wall of the housing. The second driver includes a cone coupled to a driver magnet for generating sound. The driver magnet is seated within the second aperture exposing a portion of the driver magnet to the exterior of the housing. The driver magnet is surrounded by a resilient gasket member, the gasket member being shaped and dimensioned to permit airflow about the magnet.

It is also an object of the present invention to provide a speaker assembly wherein the gasket member is non-flammable closed-cell foam.

It is also a further object of the present invention to provide a speaker assembly wherein the gasket member is positioned between an inner surface of the first wall of the housing and the first driver and the first driver is compression fit between the gasket member and a second wall such that a top edge of the first driver contacts an inner surface of the gasket member and a bottom edge of the first driver contacts the second wall with a compressive force being applied to the first driver by the gasket member and the second wall between which the first driver is positioned. As such, the first driver becomes part of the internal bracing of the housing adding to the structural stability of the loudspeaker assembly.

It is another object of the present invention to provide a speaker assembly wherein the first driver is a mid range driver.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

Figure 1:
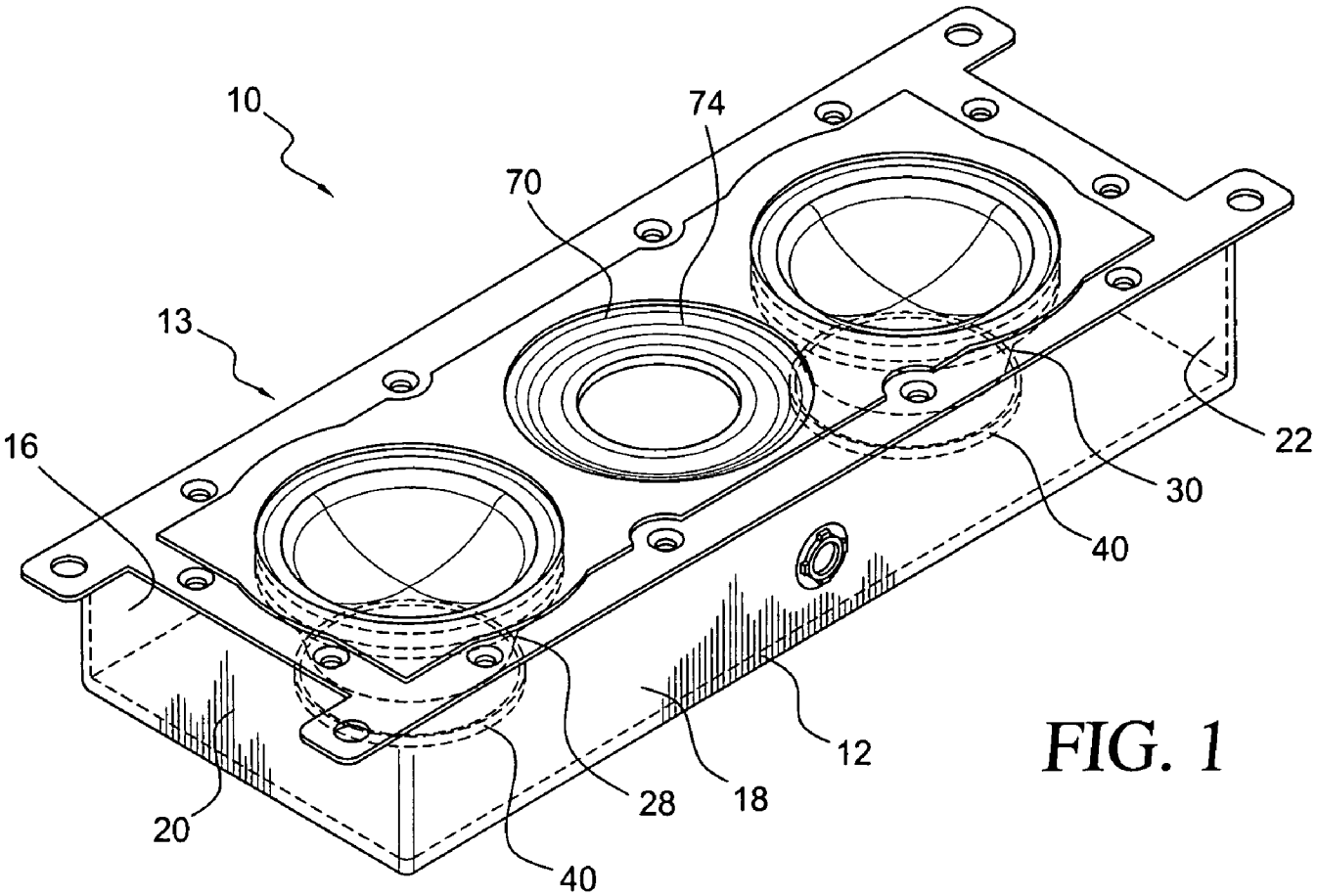
FIG. 1 is a perspective view of the speaker of the present invention with the grill removed.
Figure 2:
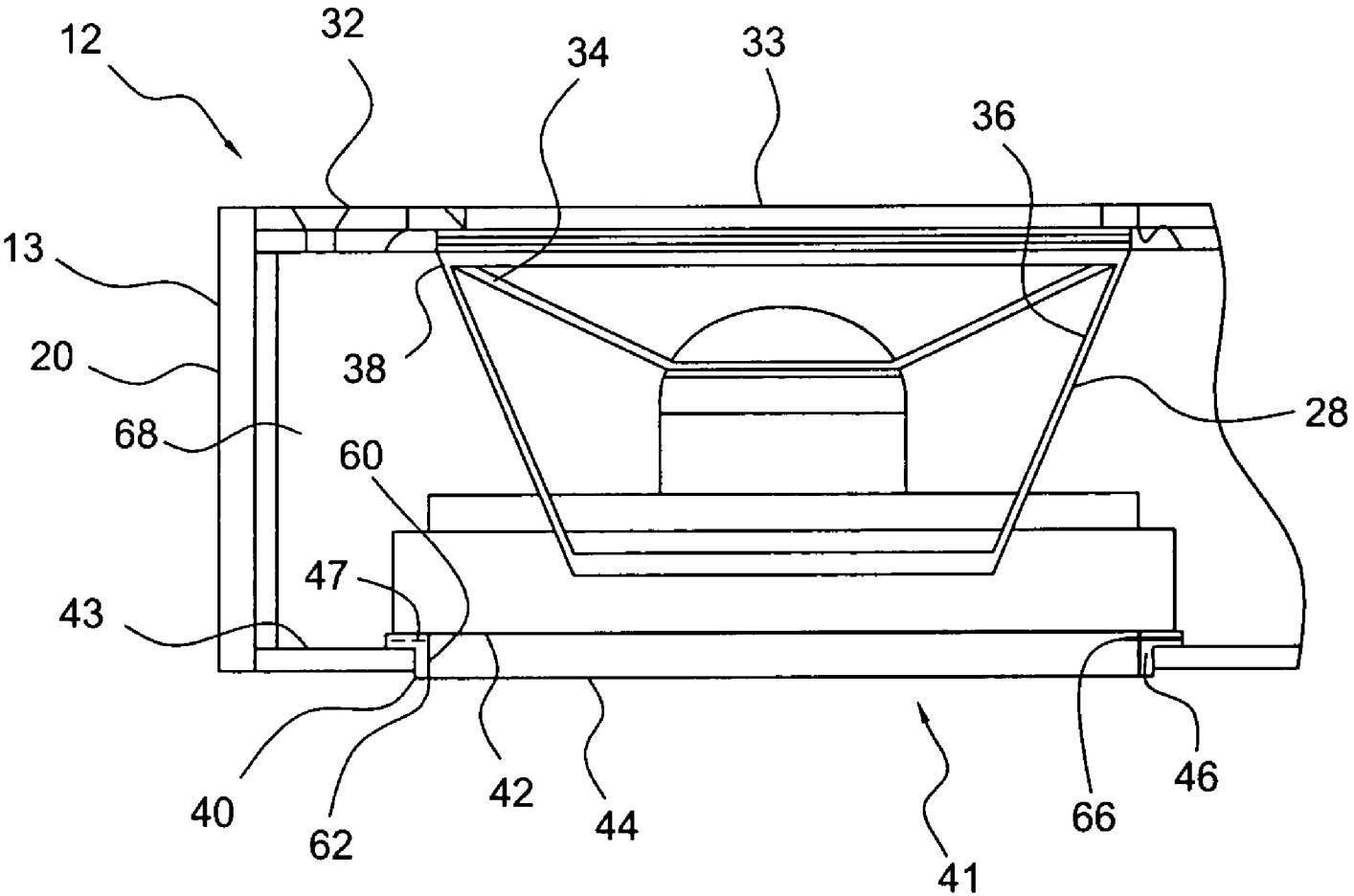
FIG. 2 is a partial cross sectional view of the speaker of the present invention.
Figure 3:
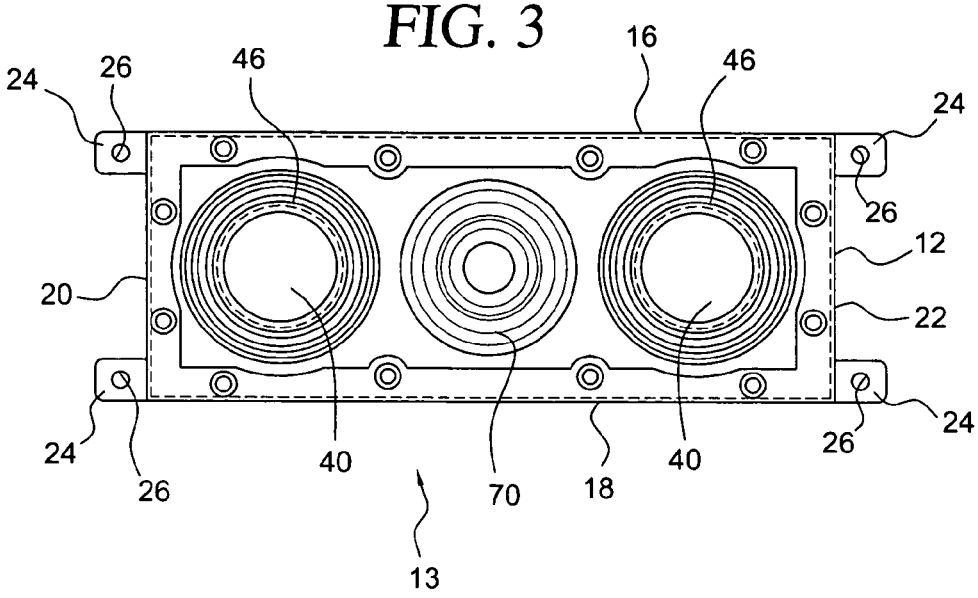
FIG. 3 is a top plan view of the speaker housing of the present invention with the grill removed.
Figure 4:
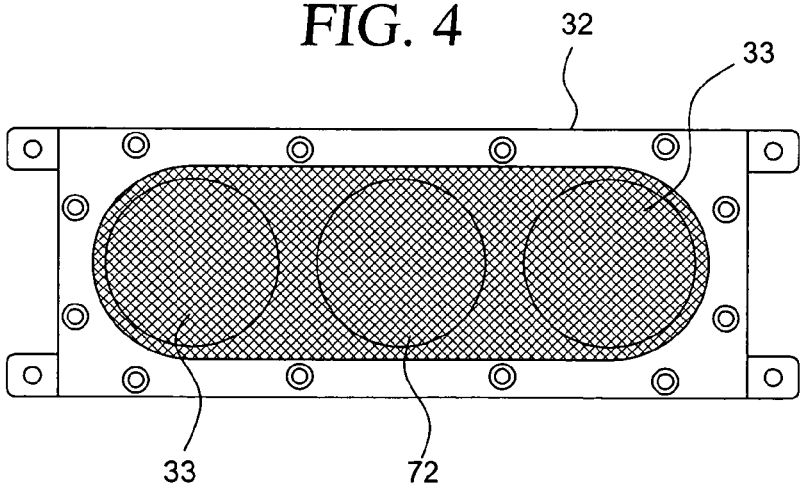
FIG. 4 is a top plan view of the grill.
Figure 5:
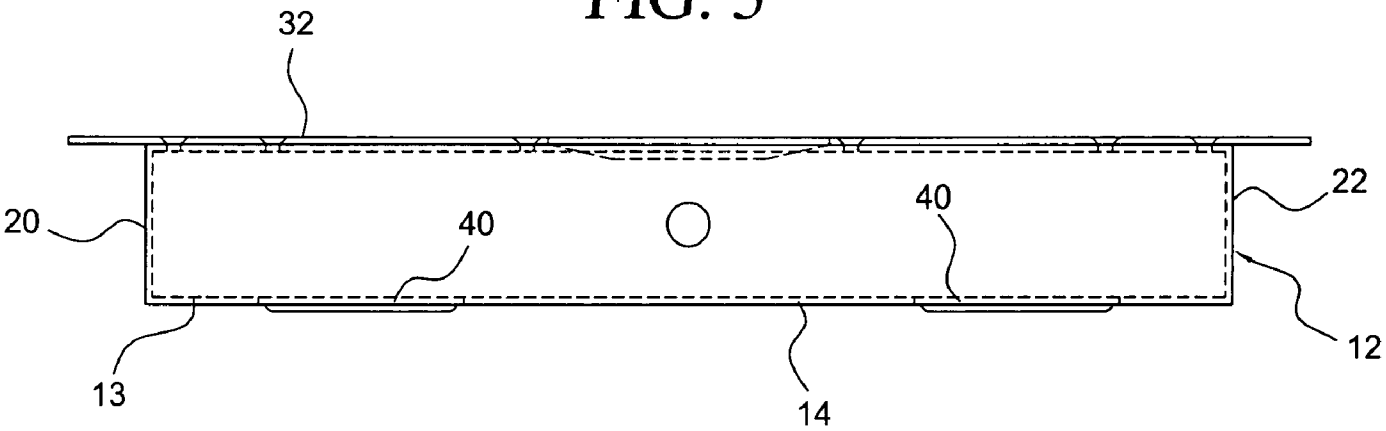
FIG. 5 is a side plan view of the speaker housing with the drivers removed.
Figure 6:
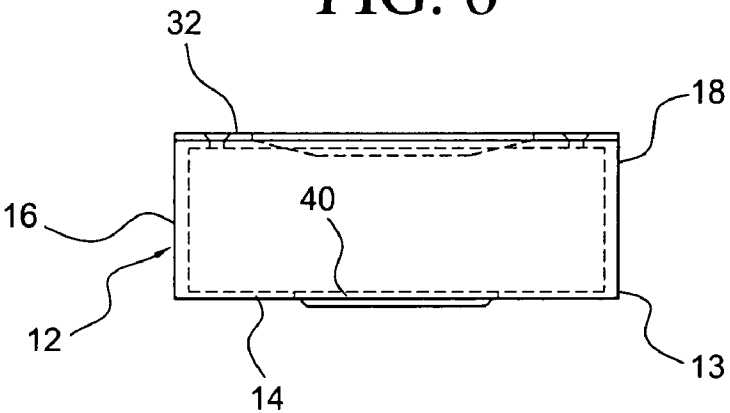
FIG. 6 is a side plan view of the speaker housing perpendicular to that shown in FIG. 5.
Figure 7:
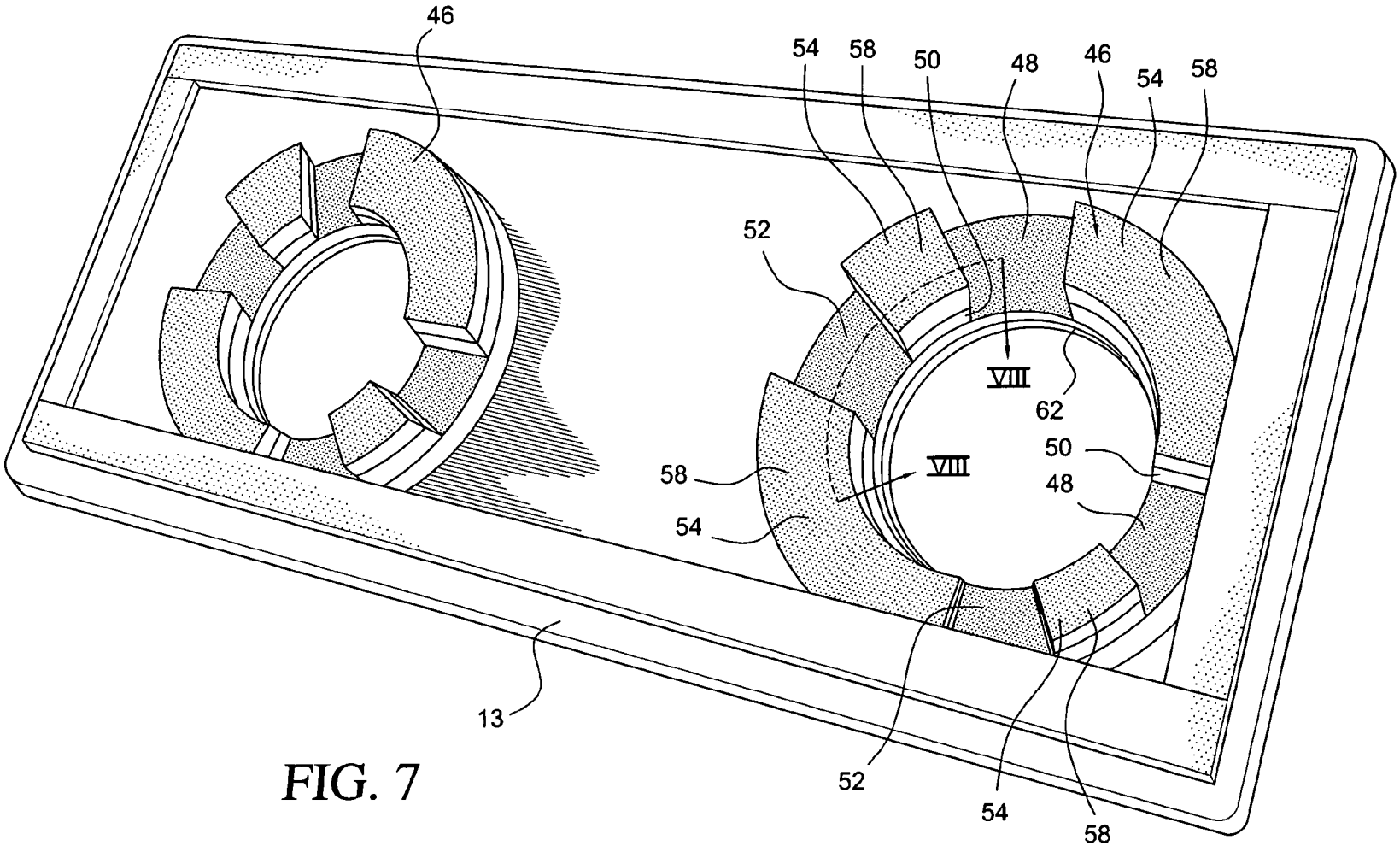
FIG. 7 is a perspective view of the speaker housing with the grill and drivers removed showing the foam gasket members in accordance with a preferred embodiment.
Figure 8:
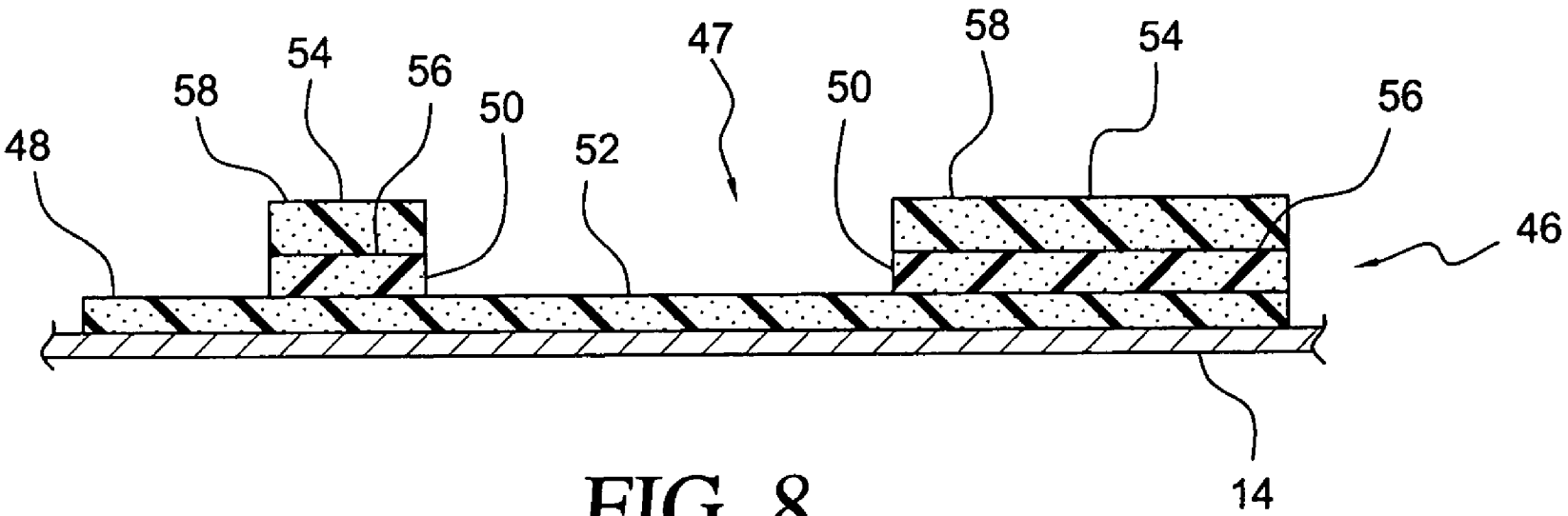
FIG. 8 is a cross sectional view of the housing shown in FIG. 7 along the line VIII-VIII.

The detailed embodiments of the present invention are disclosed herein. It should be understood, however, that the disclosed embodiments are merely exemplary of the invention, which may be embodied in various forms. Therefore, the details disclosed herein are not to be interpreted as limiting, but merely as the basis for the claims and as a basis for teaching one skilled in the art how to make and/or use the invention.

With reference to FIGS. 1 to 8, a speaker assembly 10 is disclosed. The speaker assembly 10 incorporates a variety of features which reduce the size and weight of the speaker assembly 10 without compromising the integrity of the sound generated by the speaker assembly 10. The speaker assembly 10 also incorporates various features which improve the cooling thereof and ultimate performance of the speaker assembly 10.

The speaker assembly 10 is primarily intended for use in aircraft, where weight and size are critical. While the speaker assembly is preferably designed for use in aircraft, the speaker assembly may be used in a variety of environments, such as wall and closed room speakers, automotive speakers or within personal computers, without departing from the spirit of the present invention.

As those skilled in the art will appreciate, the present speaker assembly has been disclosed without the wiring commonly employed in conjunction with speakers. As such, a variety of conventional wiring techniques may be employed within the spirit of the present invention.

Briefly, the speaker assembly 10 includes a rigid, structurally stable and self supporting speaker housing 12 within which at least a first driver 28 is mounted and enclosed. The speaker housing 12 includes a first driver aperture 40 formed in a first wall (or closed top wall) 14 of the speaker housing 12. The first driver 28 includes a cone 36 coupled to a driver magnet 42 for generating sound, wherein the driver magnet 42 is seated within the first driver aperture 40 exposing a portion of the driver magnet 42 to the exterior 41 of the speaker housing 12.

The driver magnet 42 is surrounded by, and supported upon, a resilient, closed cell foam gasket member 46. As will be discussed below in greater detail, the foam gasket member 46 is shaped and dimensioned to permit airflow between the foam gasket member 46 and the driver magnetic 42, and, therefore, about the driver magnet 42. The flow of air in this way permits cooling of the driver magnet 42 via the passage of cooler air over the driver magnet in a manner which results in the evacuation of the heat developed by the electrical and physical interaction of the voicecoil (not shown) and driver magnet 42. The foam gasket member 46 also permits movement of the first driver 28 relative to the closed top wall 14. However, and as will be appreciated based upon the following disclosure, the path between the foam gasket member 46 and the driver magnetic 42 is substantially tortuous thereby limiting the passage of sound waves therebetween.

More particularly, the speaker assembly 10 includes a speaker housing 12 with a base structure 13 composed of a closed top wall 14, closed first and second lateral side walls 16, 18 and closed front and rear side walls 20, 22. The stability of the speaker housing 12 is further enhanced through the utilization of full penetration welds in the connection of the various walls thereof. The closed top wall 14 forms a support surface upon which first and second mid range drivers 28, 30 are mounted. Other than the driver apertures 40, the closed top wall 14, closed first and second lateral side walls 16, 18 and closed front and rear side walls 20, 22 are solid and impervious to the passage of sound waves or airflow.

The speaker housing 12 further includes a grill 32 which is selectively secured to the side walls 16,18, 20, 22 to maintain the mid range drivers 28, 30 therein as described below in greater detail. The speaker housing 12 is preferably constructed from aluminum, although other materials may be employed without departing from the spirit of the present invention. The grill 32 is constructed with grill ports 33 shaped and dimensioned for alignment with the cones 36 of the drivers 28, 30. Other than the grill ports 33, however, the grill 32 is solid and impervious to the passage of sound waves or airflow. In this way, the speaker housing 12 is a substantially closed enclosure with only the grill ports 33 permitting the passage of sound emitted by the drivers 28, 30 and the foam gasket members 46 permitting the passage of air between the foam gasket member 46 and the driver magnet 42 (and ultimately out of the enclosure defined by the speaker housing 12).

In accordance with a preferred embodiment of the present invention, the closed top wall 14 is substantially rectangular, although other shapes may be employed without departing from the spirit of the present invention. Four corner mounts 24 respectively extend from their respective ends of the front and rear side walls 20, 22. Each corner mount 24 includes an aperture 26 adapted for attaching the speaker assembly 10 within the fuselage of an aircraft. The corner mounts 24 attach to a mounting bracket (not shown) of the aircraft. The mounting bracket is adapted to facilitate the installation of the present speaker assembly 10 within an aircraft fuselage.

The active components of the speaker assembly 10 include first and second mid range drivers 28, 30. As explained in commonly owned U.S. Pat. Nos. 6,463,160 and 6,719,090, which are incorporated herein by reference, the mid range drivers 28, 30 are compression fit within the speaker assembly 10. In particular, they are held between the closed top wall 14, in particular, the gasket member 46 which sits upon the closed top wall 14, and the grill 32 of the speaker assembly 10.

In practice, and with reference to the first mid range driver 28, the grill 32 is bolted to the base structure 13, in particular, the grill 32 is secured to the exposed edges of the first and second lateral side walls 16, 18 and the front and rear side walls 20, 22 with screws. In this way, the base structure 13 and the grill 32 form an enclosure within which the mid range driver 28 is held. Although the first mid range driver 28 is disclosed herein in detail, those skilled in the art will appreciate the following description applies equally well to the second mid range driver 30.

The mid range driver 28 is positioned within the enclosure defined by the grill 32 and the base structure 13 such that the interior surface 34 of the cone 36 is directed toward the grill 32. In fact, the upper edge 38 of the cone 36 has a radius which is in alignment with an outer edge of the grill port 33 formed in the grill 32.

The mid range driver 28 is compression fit between the closed top wall 14 of the speaker housing 12 and the grill 32 such that the interior surface 34 of the cone 36 of the mid range driver 28 faces the grill 32. The exterior upper edge 38 of the cone 36 is directly attached to the grill 32 along the grill port 33 to provide a port for the transmission of sound. Secure attachment is achieved by using screws or adhesive (or other coupling structures) to securely attach the mid range driver to the grill 32.

The compression fit of the mid range driver 28 within the enclosure defined by the grill 32 and the base structure 13 is further enhanced by forming a driver aperture 40 within the top closed wall 14. The driver aperture 40 is shaped and dimensioned to receive and support the magnet 42 and the mid range driver 28. The driver magnet 42 of the mid range driver 28 is seated within the driver aperture 40. Specifically, the closed top wall 14 is formed in such a way to provide a space in which the back plate 44 of the driver magnet 42 may fit while the remainder of the driver magnet 42 sits on the gasket member 46, which in turn sits on the inner surface 43 portion of the closed top wall 14, adjacent the driver aperture 40. As such, a portion of the driver magnet 42 of the mid range driver 28 is encircled by a resilient, non-flammable foam gasket member 46 and is fit within the driver aperture 40 to essentially become part of the closed top wall 14. In this way, the foam gasket member 46 is positioned between the inner surface 43 of the closed top wall 14 and the mid range driver 28.

By positioning the gasket member 46 between the mid range driver 28 and the inner surface 43 of the closed top wall 14, the resilience of the gasket member 46 permits incursion and excursion of the mid range driver 28 during operation thereof. As will be discussed below in greater detail, this movement enhances performance of the present speaker assembly 10 by enhancing cooling and absorbing undesirable resonance.

In accordance with a preferred embodiment, the foam gasket member is composed of ENSOLITE IV1, a closed cell foam material made from a blend of a Poly Vinyl Chloride (PVC) and Nitrile Butadiene Rubber (NBR). Although a preferred material construction is contemplated for the gasket member in accordance with a preferred embodiment of the present invention, it is contemplated the gasket member may be formed from a variety of resilient materials adapted for permitting the compression fit and the flow of air about the magnet.

In addition to allowing for the compression fit of the driver magnet 42 within the driver aperture 40, the foam gasket member 46 also prevents rattling of components within the speaker assembly 10. The foam gasket member 46 is also positioned such that leads 66 of the driver 28 sit within the foam gasket member 46 in a manner preventing resonance thereof.

The foam gasket member 46 also permits movement of the mid range driver 28 during incursion and excursion of the cone 36. By supporting the mid range driver 28 in a manner which permits movement of the mid range driver 28 relative to the closed top wall 14, improved performance is achieved by minimizing undesirable mid range resonance commonly encountered when drivers are positioned within a small enclosure. The foam gasket member 46 further functions to absorb undesirable mid range frequencies as a result of the closed cell construction thereof.

Airflow about the magnet 42 is achieved by forming a series of open spaces 47 between the foam gasket member 46 and the driver magnet 42, wherein the open spaces 47 extend about the driver magnet 42. The open spaces 47 provide a tortuous path from the interior 68 of the enclosure defined by housing 12, to the space between the inner surface 62 of the foam gasket member 46 and the outer surface 60 of the driver magnet 42, and to the exterior 41 of the housing 12. In this way, as the mid range driver 28 is actuated, moving air within the enclosure of the speaker housing 12, the air is forced through the open spaces 47 in the foam gasket member 46, and between the outer surface 60 of the driver magnet 42 and the inner surface 62 of the foam gasket member 46, such that it circulates about the magnet 42 in a manner cooling the driver magnet 42.

In addition to providing for the cooling of the driver magnet 42 as air passes thereby, the ability of compressed air to escape the enclosure as the open spaces 47 permit during movement of the driver 28, 30 reduces interferences between the first and second mid range drivers 28, 30 as vibrations generated by the drivers 28, 30 are either absorbed by the foam gasket members 46 or escape the enclosure via the opens spaces 47. The ability of the present structure to reduce interference between drivers supported within the same enclosure, could be extended to speaker arrays by permitting the mounting of multiple drivers within the same enclosure without worrying that various drivers will interfere with each other.

More particularly, because of the nature of midrange-resonance propagation in small enclosures there are inherent benefits in mitigating the midrange resonances utilizing the closed-cell foam gasket member 46 under compression damping both the "box" (that is, the housing) and the driver frame. Additionally, as the drivers 28, 30 move air into and out of the enclosure defined by the speaker housing 12 in a manner proportionate to the amplitude of the audio signal being reproduced, it becomes possible to incorporate multiple drivers 28, 30 within the enclosure without creating a compounding effect normally associated with multiple drivers in the same enclosure. The "compounding effect" is a result of the change of air pressure on the unexposed or "backside" of the driver cone which is significantly increased by the presence of one or more additional drivers within the same airspace. Certain frequencies are exaggerated by this effect, always to the detriment of accurate sound reproduction. While it is possible to reduce this effect electrically, doing so adds weight, cost and complexity to the system and does not provide the critical benefit of using the air movement to cool the voicecoil/magnet structure.

In accordance with a preferred embodiment, the open spaces 47 are created by forming the foam gasket member 46 with a step construction. That is, the foam gasket member 46 includes an annular base 48 which is secured directly to the closed top wall 14. Extending from the base 48 are four first elevation members 50 secured to the exposed upper surface 52 of the base 48. Extending from the first elevation members 50 are respective second elevation members 54. The base 48, first elevation members 50 and second elevations members 54 define three levels along the upper surface of the foam gasket member 46. The three levels are in the form of steps, the first level being the exposed upper surface 52 of the base 48, the second level being the upper surface 56 of the first elevation members 50 (which is covered by the second elevation members 52) and the third level being the exposed upper surface 58 of the second elevation members 52.

Figure 9:
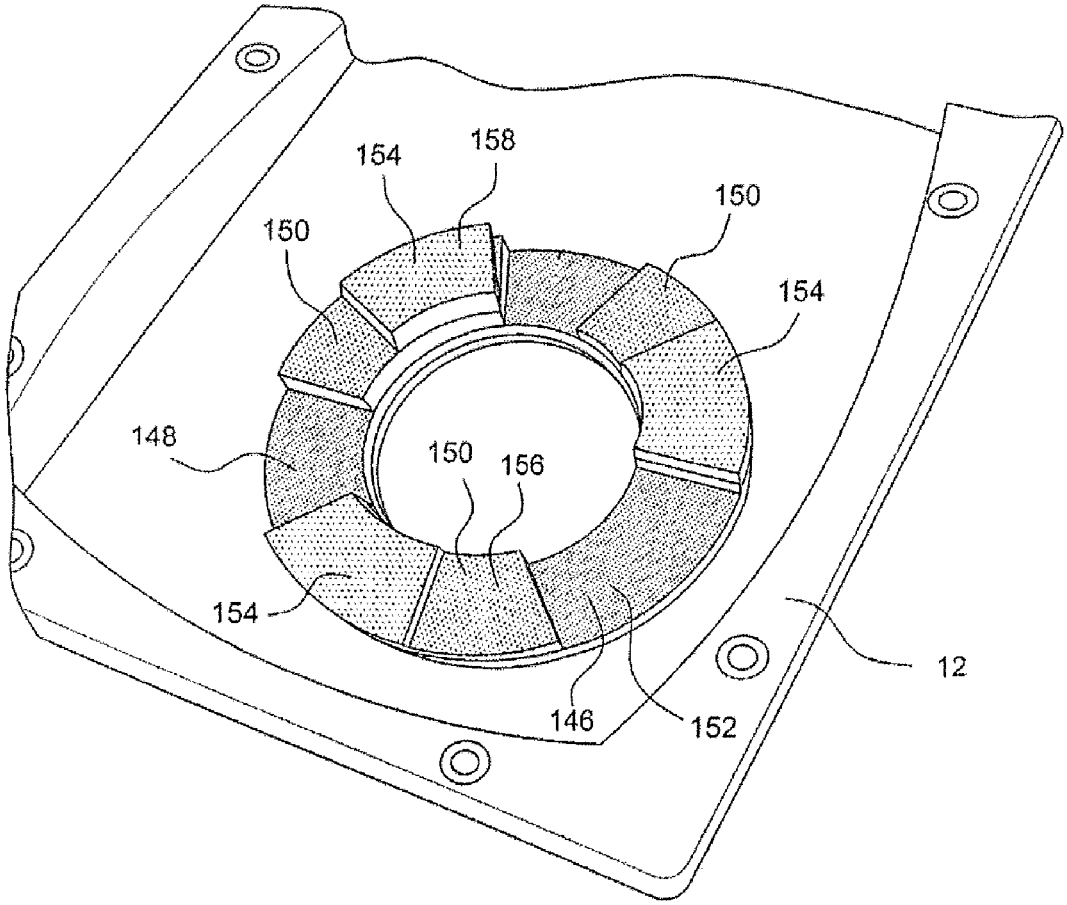
FIG. 9 is a perspective view of the speaker housing with the grill and drivers removed showing the foam gasket member in accordance with an alternate embodiment of a preferred embodiment.

Although a preferred foam gasket member construction is disclosed above in accordance with a preferred embodiment of the present invention, the spacing may be created in various other ways. For example, and with reference to FIG. 9, the foam gasket member may be constructed such that the foam gasket member 146 includes an annular base 148 which is secured directly to the closed top wall 14. Extending from the base 148 are four first elevation members 150 secured to the exposed upper surface 152 of the base 148. Extending from the first elevation members 150 are respective second elevation members 154. The base 148, first elevation members 150 and second elevations members 154 define three levels along the upper surface of the foam gasket member 146. The three levels are in the form of steps, the first level being the exposed upper surface 152 of the base 148, the second level being the exposed upper surface 156 of the first elevation members 150 and the third level being the exposed upper surface 158 of the second elevation members 152.

In addition to providing a secure enclosure for the mid range driver 28, positioning of the driver magnet 42 within the closed top wall 14 of the housing 12 provides space saving in the profile of the speaker assembly 10. This provides critical additional space for reducing the profile of the present speaker assembly 10. Positioning of the driver magnet 42 within the driver aperture 40 also helps to align the mid range driver 28 within the speaker housing 12.

In addition to reducing the profile and weight of the speaker assembly 10, the present design improves the structural integrity of the speaker assembly 10. By compression fitting the mid range driver 28 between the driver aperture 40 of the closed top wall 14 and the grill 32, the mid range driver 28 becomes part of the internal bracing of the speaker assembly 10 and add to the structural stability thereof. The exposed magnet 42 also provides a natural heat sink for cooling the mid range driver 28.

It is also contemplated one may wish to include a public address driver 70 within the speaker assembly. As such, the grill 32 may be formed with a public address port 72 about which the cone 74 of the public address driver is secured in a conventional manner.

As discussed above, although the disclosed embodiment shows a speaker assembly with only first and second mid range drivers, it is contemplated the speaker assembly may include various drivers, including tweeters and public address drivers, without departing from the spirit of the present invention.

While the preferred embodiments have been shown and described, it will be understood that there is no intent to limit the invention by such disclosure, but rather, is intended to cover all modifications and alternate constructions falling within the spirit and scope of the invention.

The invention claimed is:

1. A speaker assembly, comprising:

a rigid, structurally stable and self supporting housing within which at least a first driver is mounted and enclosed, the housing including a first aperture formed in a first wall of the housing;

the first driver including a cone coupled to a driver magnet for generating sound;

the driver magnet is seated within the first aperture exposing a portion of the driver magnet to an exterior of the housing;

the driver magnet being encircled by a resilient gasket member shaped and dimensioned to permit airflow about the magnet.

2. The speaker assembly according to claim 1, wherein the gasket member is positioned between an inner surface of the first wall of the housing and the first driver.

3. The speaker assembly according to claim 2, wherein the gasket member includes a series of open spaces between the gasket member and the driver magnet such that as the first driver is actuated, moving air within the enclosure of the housing, the air is forced through the open spaces such that it circulates about the magnet in a manner cooling the driver magnet.

4. The speaker assembly according to claim 3, wherein the open spaces extend about the driver magnet.

5. The speaker assembly according to claim 3, wherein the open spaces are created by forming the gasket member with a step construction.

6. The speaker assembly according to claim 5, wherein the gasket member includes an annular base secured directly to the inner surface of the first wall, and a series of spaced first elevation members are secured to the base defining open spaces therebetween.

7. The speaker assembly according to claim 6, further including a series of spaced second elevation members secured to the respective first elevation members in a manner further defining open spaces.

8. The speaker assembly according to claim 1, further including a second driver mounted and enclosed within the housing, the housing further including a second aperture formed in the first wall of the housing, the second driver including a cone coupled to a driver magnet for generating sound, the driver magnet is seated within the second aperture exposing a portion of the driver magnet to the exterior of the housing, the driver magnet being surrounded by a resilient gasket member, the gasket member being shaped and dimensioned to permit airflow about the magnet.

9. The speaker assembly according to claim 1, wherein the gasket member is non-flammable closed-cell foam.

10. The speaker assembly according to claim 1, wherein the gasket member includes a series of open spaces between the gasket member and the driver magnet such that as the first driver is actuated, moving air within the enclosure of the housing, the air is forced through the open spaces such that it circulates about the magnet in a manner cooling the driver magnet.

11. The speaker assembly according to claim 10, wherein the open spaces extend about the driver magnet.

12. The speaker assembly according to claim 11, wherein the open spaces are created by forming the gasket member with a step construction.

13. The speaker assembly according to claim 12, wherein the gasket member includes an annular base which is secured directly to the inner surface of the first wall, and a series of spaced first elevation members are secured to the base defining open spaces therebetween.

14. The speaker assembly according to claim 13, further including a series of spaced second elevation members secured to the respective first elevation members in a manner further defining open spaces.

15. The speaker assembly according to claim 1, wherein the gasket member is positioned between an inner surface of the first wall of the housing and the first driver and the first driver is compression fit between the gasket member and a second wall such that a top edge of the first driver contacts an inner surface of the gasket member and a bottom edge of the first driver contacts the second wall with a compressive force being applied to the first driver by the gasket member and the second wall between which the first driver is positioned, and wherein the first driver becomes part of the internal bracing of the housing adding to the structural stability of the loudspeaker assembly.

16. The speaker assembly according to claim 1, wherein the first driver is a mid range driver.

* * * * *